United States Patent [19]

Greenbaum

[11] Patent Number: 5,041,013

[45] Date of Patent: Aug. 20, 1991

[54] ELECTRICAL CONNECTOR

[75] Inventor: Arthur Greenbaum, Scarsdale, N.Y.

[73] Assignee: Academy Electrical Corporation, Yonkers, N.Y.

[21] Appl. No.: 582,825

[22] Filed: Sep. 14, 1990

Related U.S. Application Data

[63] Continuation of Ser. No. 23,956, Mar. 11, 1987, abandoned, which is a continuation of Ser. No. 906,683, Sep. 11, 1986, abandoned, which is a continuation of Ser. No. 312,760, Oct. 16, 1981, abandoned.

[51] Int. Cl.[5] ..... H01R 4/24

[52] U.S. Cl. ..... 439/425

[58] Field of Search ..... 439/389–426

[56] References Cited

U.S. PATENT DOCUMENTS

| | | | |
|---|---|---|---|
| 2,159,064 | 5/1939 | Walter | 173/361 |
| 2,419,652 | 4/1947 | McLarn | 339/97 P |
| 2,475,243 | 7/1949 | Irrgang | 173/361 |
| 2,609,415 | 9/1952 | Benander et al. | 173/361 |
| 2,647,245 | 7/1953 | Gilbert | 339/99 |
| 2,658,184 | 11/1953 | Greenbaum | 339/99 |
| 2,673,968 | 3/1954 | Smith | 339/99 |
| 2,682,647 | 6/1954 | Smith | 339/99 R |
| 2,704,832 | 3/1955 | Greenbaum | 339/99 R |
| 2,717,365 | 9/1955 | Greenbaum | 339/99 |
| 2,735,078 | 2/1956 | Greenbaum | 339/99 |
| 2,769,154 | 10/1956 | Greenbaum | 339/99 |
| 2,810,894 | 10/1957 | Kerr | 339/99 |
| 3,012,219 | 12/1961 | Levin et al. | 339/98 |
| 3,397,380 | 8/1968 | Puig | 339/99 |
| 3,408,616 | 10/1968 | Greenbaum | 339/99 |
| 3,609,644 | 9/1971 | Seim | 339/98 |
| 3,816,819 | 6/1974 | Judd | 339/99 |
| 3,858,157 | 12/1974 | Bazille, Jr. | 339/98 |
| 3,874,762 | 4/1975 | Shott et al. | 339/91 |
| 3,976,351 | 8/1976 | Hopfe | 339/99 |
| 3,980,379 | 9/1976 | Bone | 339/98 |
| 4,023,883 | 5/1977 | Raposa et al. | 339/98 |
| 4,037,905 | 7/1977 | Lucas | 339/98 |
| 4,077,695 | 3/1978 | Bakermans | 339/176 |
| 4,129,350 | 12/1978 | Winn | 339/99 |
| 4,243,287 | 1/1981 | Smith et al. | 339/99 |

FOREIGN PATENT DOCUMENTS

| | | | |
|---|---|---|---|
| 508583 | 2/1952 | Belgium . | |
| 1401358 | 4/1965 | France | 339/99 L |
| 383458 | 1/1965 | Switzerland | 339/99 R |

*Primary Examiner*—Joseph H. McGlynn
*Attorney, Agent, or Firm*—Thomas L. Secrest

[57] ABSTRACT

An electrical connector is disclosed which may be installed on most commonly-available household electrical cords without tools and with no need to either slit or strip the cords. An internal channel in the connector is designed so that the various sizes of cords are compressed and distorted by the force of closing of the connector housing with the result that the conductor elements of the cord are aligned with piercing prongs despite variations in the size and spacing of the conductor elements and insulation thickness.

12 Claims, 6 Drawing Sheets

FIG. 1
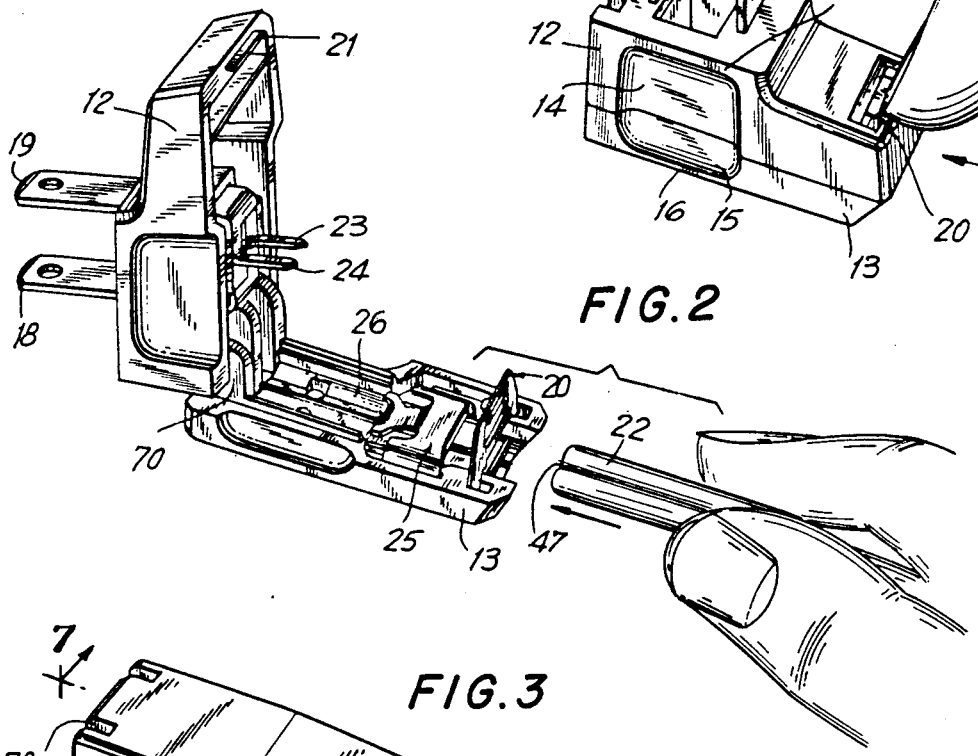
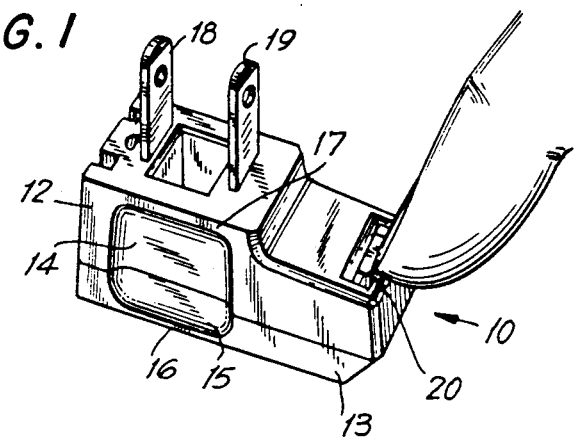
FIG. 2
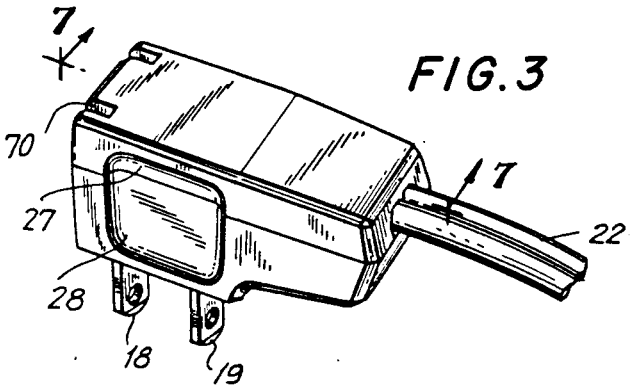
FIG. 3
FIG. 4
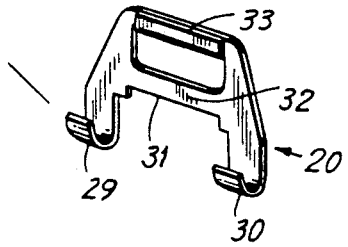
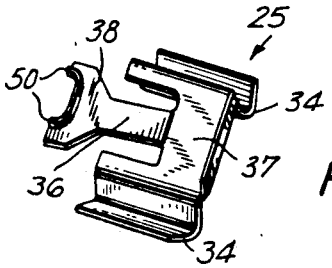
FIG. 5

FIG.6a
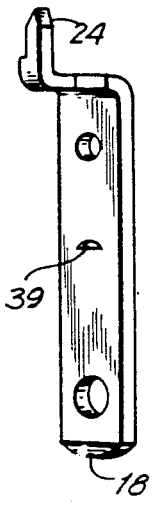
FIG.6b
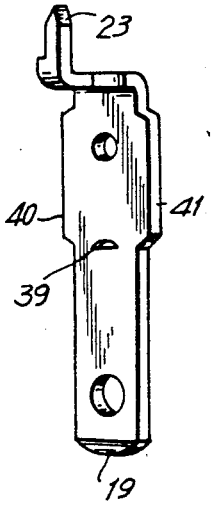
FIG.6c
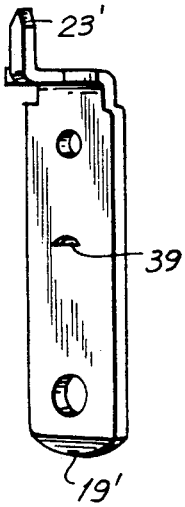
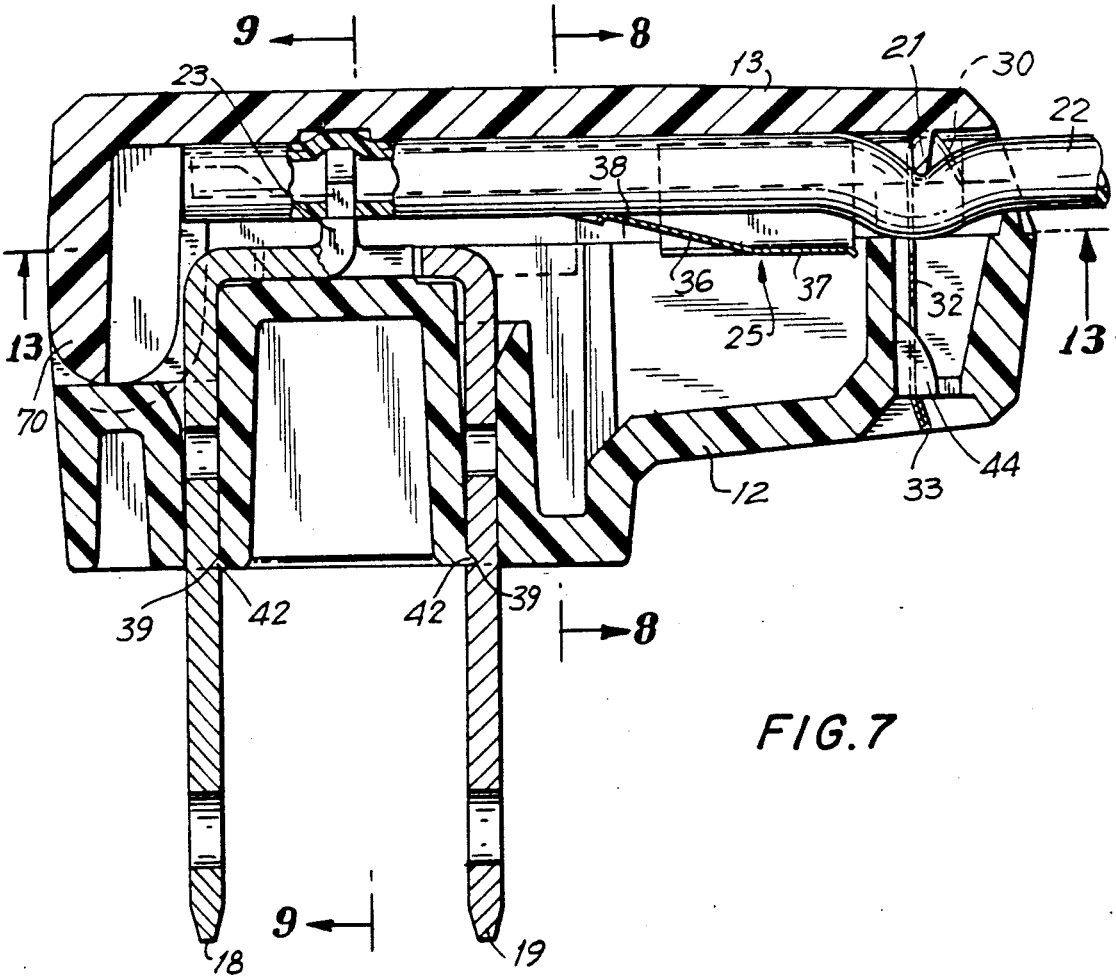
FIG.7

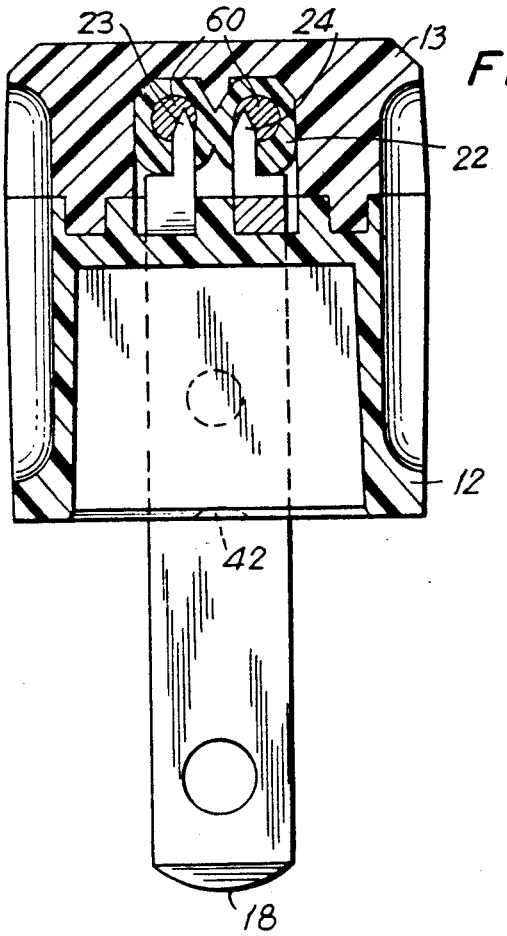
FIG. 9
FIG. 10
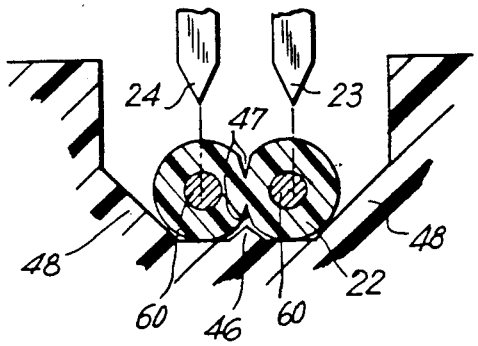
FIG. 11
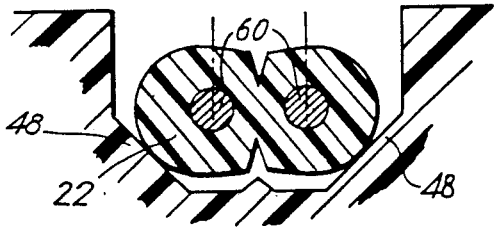
FIG. 12
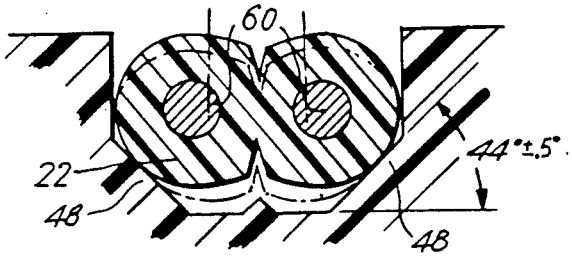

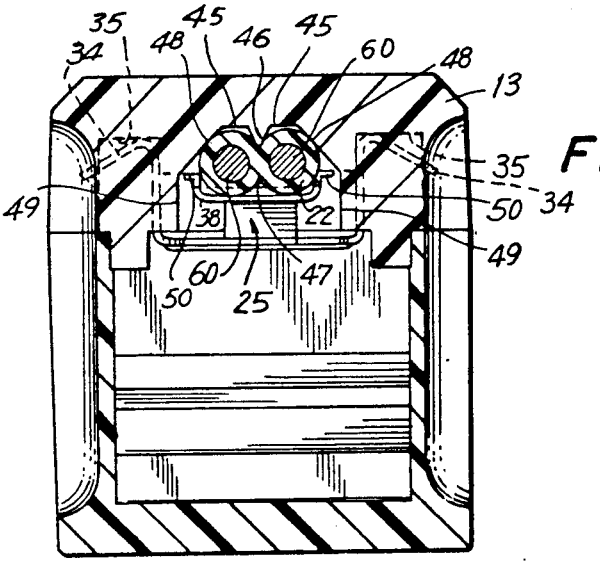
FIG. 8
FIG. 13
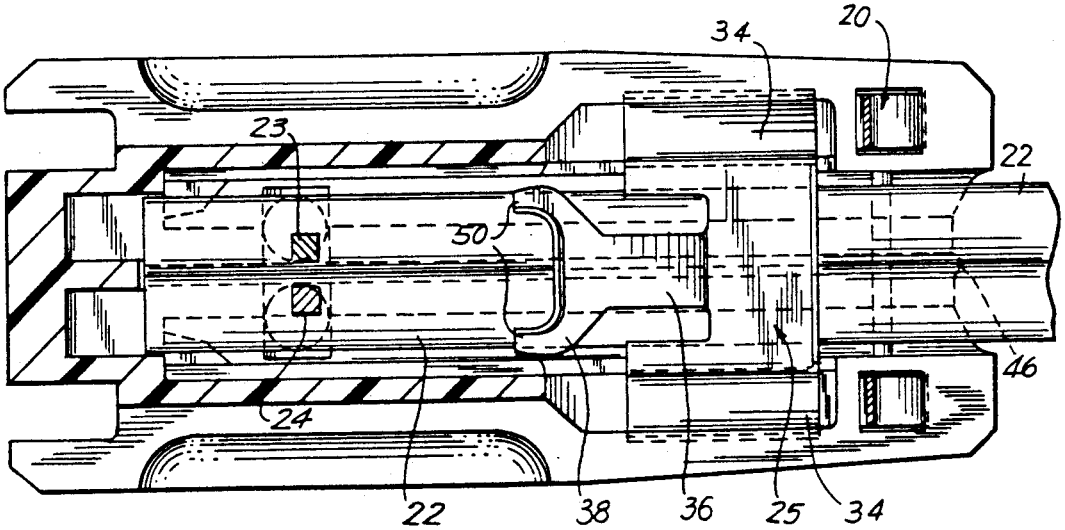

ELECTRICAL CONNECTOR

This is a continuation, of application Ser. No. 023,956, filed Mar. 11, 1987, entitled Electrical Connector, now abandoned which is a continuation, of application Ser. No. 906,683, filed Sept. 11, 1986, entitled Electrical Connector, now abandoned, which is a continuation, of application Ser. No. 312,760, filed Oct. 16, 1981, entitled Electrical Connector, now abandoned.

BACKGROUND OF THE INVENTION

The present invention pertains to electrical connectors generally, and to electrical plugs and socket receptacles in particular. This invention provides a pin-piercing connector that may be installed on most commonly-used flat household electrical cords without tools and with no need to slit or strip the cords. Internally, the connector is adapted to enable its use with most common sizes of flat household insulated electrical conducting cord having two electrical conducting elements, such as cords in the size range of SPT-1 18 to SPT-2 18 to SPT-2 16 and HPN wires. The design of the channel inside the housing where the cord is inserted allows use of various cord sizes because the force of the piercing prongs as they penetrate the cord's insulation distorts and compresses the insulation within the channel so that the prongs are aligned with the internal electrical conducting wire elements despite variations in the spacing of those wires due to differing insulation thickness. Furthermore, the connector may be installed quickly, safely, and securely without the use of tools.

Prior art connectors, such as those disclosed in U.S. Pat. Nos. 3,408,616 and 4,243,287, suffer from the disability of being usable only with one size of conductor cord. Most prior art connectors also require the use of tools for installation. Although some earlier connectors, such as that in U.S. Pat. No. 3,816,819, have channels large enough to accept various cord sizes, none provides for alignment of the piercing prongs with the internal conductor elements as insulation thickness and conductor element spacing varies without either slitting or stripping the cords. Without such alignment, there is no assurance of a secure contact between the wire and the piercing prongs, which contact is essential to the function and safety of an electrical connector.

SUMMARY OF THE INVENTION

The connector of this invention includes a housing with an internal channel which is open on at least one end for receiving an electrical cord, the walls of which channel are formed at such an angle to the channel floor that the force of the piercing prongs compresses and distorts the cord to align the internal conductor wires with prongs despite varying conductor spacing. Alignment of the prongs and wires is further insured by the action of a retaining clip mounted in the housing which cooperates with an aligning rib in the channel floor to center the electrical cord in the channel regardless of the cord size or insulation thickness. In the receptacle version of the connector, this clip is not required.

It is an object of this invention to provide an electrical connector in which an internal channel for receiving an electrical cord is designed so that the closing of the housing around the cord results in a distorting and compressing force on the cord that aligns the internal conducting elements of the cord with electrically conductive piercing prongs mounted in the housing which, upon piercing the insulation of the cord, make a secure electrical contact with the conducting elements despite variations in cord size, insulation thickness, and conductor element spacing.

It is another object of this invention to provide an electrical connector in the form of a plug or receptacle which may be used with most commonly used household electrical cords.

It is another object of this invention to provide an electrical connector which may be manufactured easily and economically.

It is yet another object of this invention to provide an electrical connector which can be readily adapted to form a regular or a polarized plug or receptacle.

It is a further object of this invention to provide an electrical connector for use with various sizes of electrical cord which may be installed without tools and without slitting or stripping the cord.

BRIEF DESCRIPTION OF THE DRAWINGS

FIG. 1 is a perspective view of the electrical connector of this invention in its plug configuration.

FIG. 2 is a view of the connector of FIG. 1 opened up to receive an electrical cord.

FIG. 3 is a top view of the connector of FIG. 1.

FIG. 4 is a detail view of locking clip 20, of FIG. 2.

FIG. 5 is a detail view of retaining clip 25, of FIG. 2.

FIGS. *6a*, *6b* and *6c* are views of three types of blades usable in the electrical connector of the present invention.

FIG. 7 is a sectional view of the electrical connector taken along line 7—7 of FIG. 3.

FIG. 8 is a sectional view of the connector taken along line 8—8 of FIG. 7.

FIG. 9 is a sectional view of the connector taken along the line 9—9 of FIG. 7.

FIGS. 10–12 are sectional views showing the penetration of wires having conductor elements of varying gauges and with varying insulation thicknesses.

FIG. 13 is a sectional view of the connector taken along line 13—13 of FIG. 7.

Figure 14:
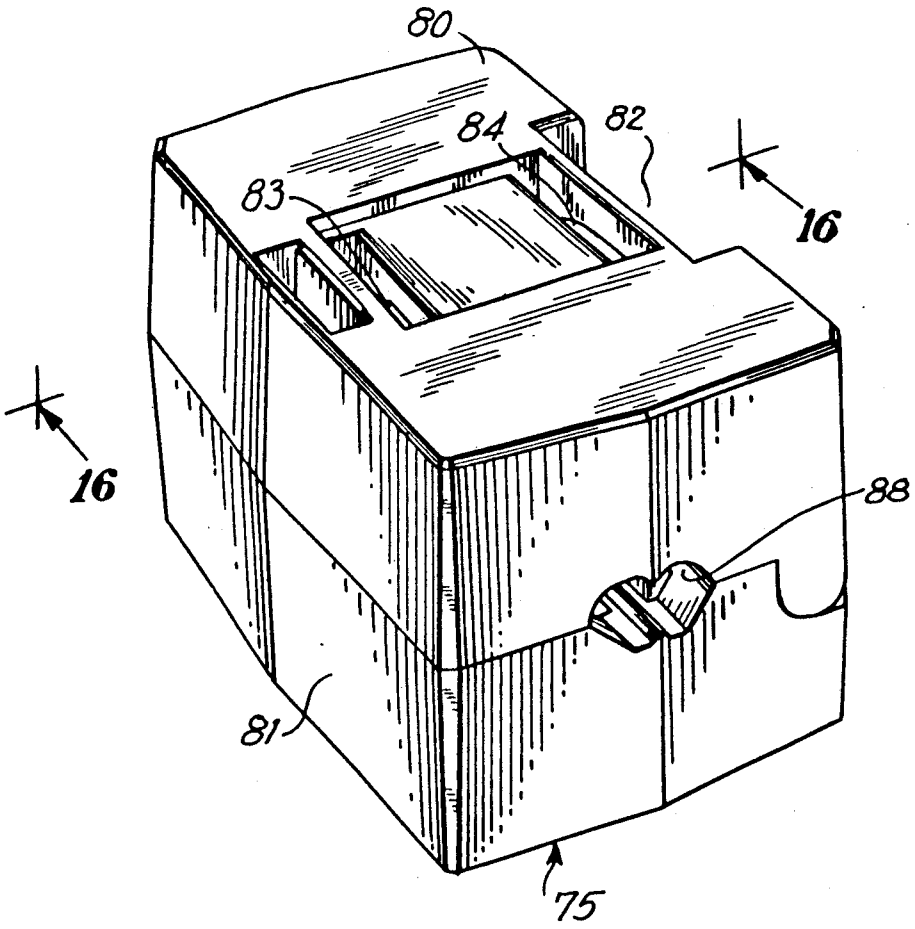

FIG. 14 is a perspective view of the connector in its receptacle form.

Figure 15:
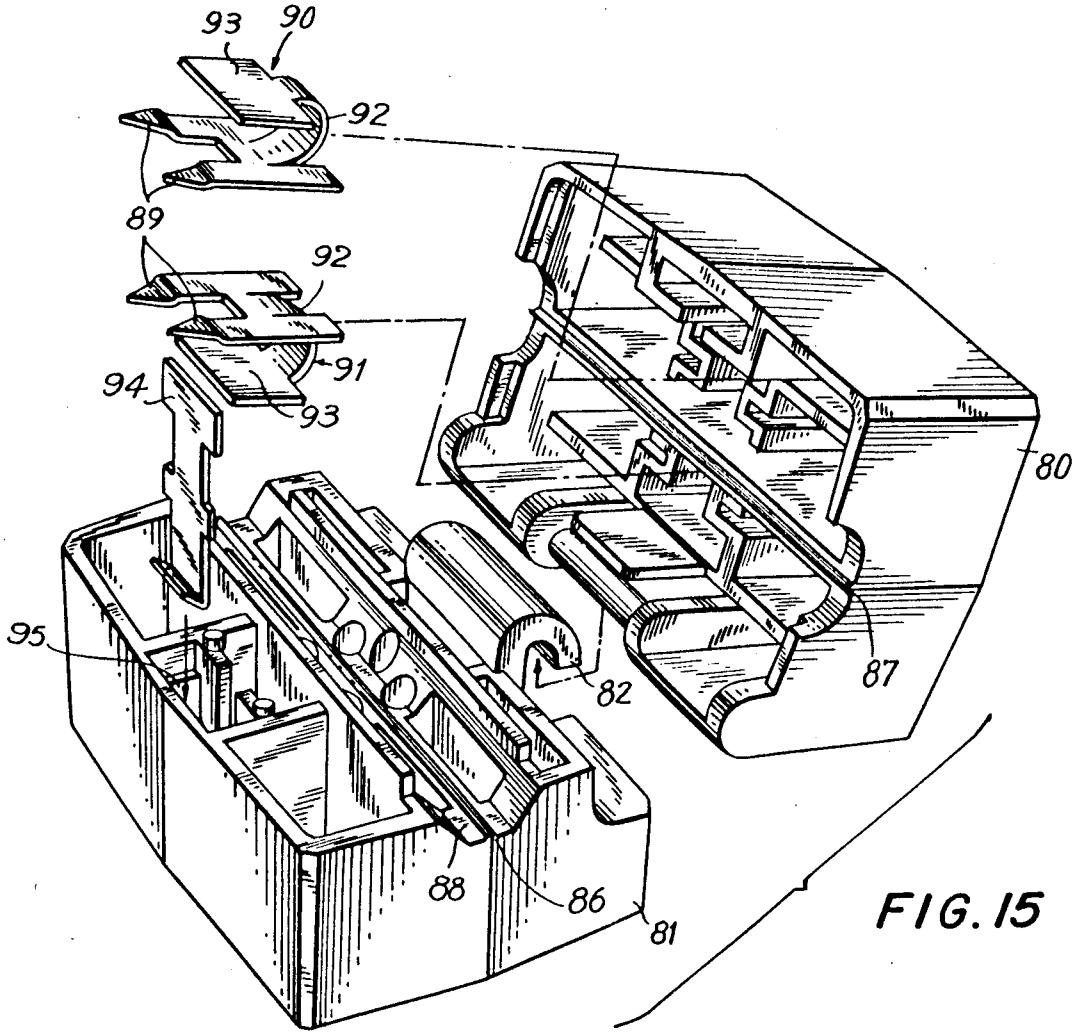

FIG. 15 is an exploded view of the connector of FIG. 14.

Figure 16:
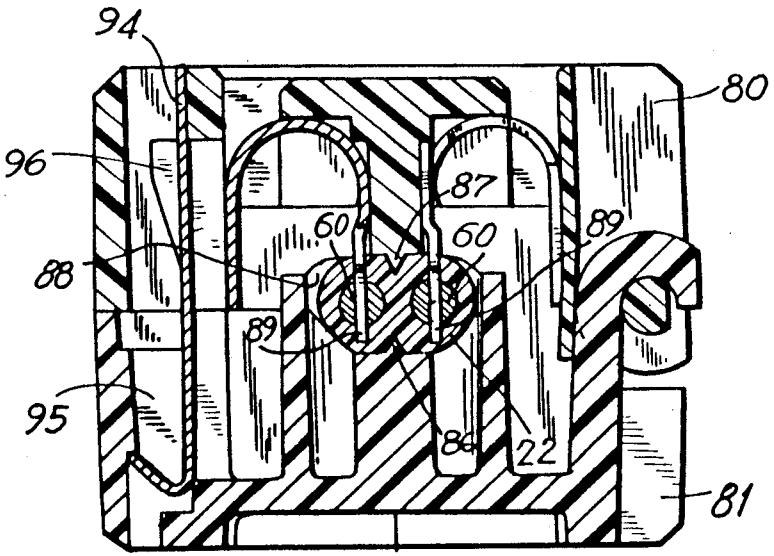

FIG. 16 is a sectional view of the connector of FIG. 14 taken along line 16—16.

DETAILED DESCRIPTION OF THE PREFERRED EMBODIMENT

FIGS. 1–3 depict the electrical connector 10 of the present invention in the form of an electrical plug. The connector has a housing 11 made of a suitable plastic insulating material, such as polyester, nylon or polypropolene. The housing is formed in two hingedly-connected sections, a base 12 and a cover 13, and is designed externally for safer use, in that there are recesses provided to prevent a user's fingers from slipping either forward or backward off the connector. The base 12 and the cover 13 each have indentations, 14 and 15 respectively, which cooperate to form a recessed grasping area. The resulting shoulders 16 and 17 prevent the user's fingers from slipping off of the plug during insertion to or extraction from an electrical receptacle. Similar indentations 27 and 28 and shoulders are found on the reverse side of the connector. The connector has contact means, such as blades 18 and 19, made of an appropriate electrically-conducting material and adapted for insertion into an electrical receptacle. A locking clip 20 secures the connector in the closed position after insertion of an electrical cord.

FIG. 4 shows the details of locking clip 20, which is formed with retaining feet 29 and 30, which hold the clip in the housing cover 13, and cross member 32 extending horizontally between feet 29 and 30. The bottom 31 of cross-member 32 abuts the top of cord 22 when the connector is closed and helps to hold cord 22 in place as best shown in FIG. 7. Cross member 33 engages a projection 44 (FIG. 7) in housing base 12 to securely lock the connector in the closed position.

FIG. 2 shows the electrical connector 10 of FIG. 1 opened at its hinged end for receiving an electrical cord 22. Prongs 23 and 24 extend into the housing and are electrically connected to blades 18 and 19 respectively. Preferably, each blade and its associated prong is an integral piece of suitable electrically-conducting material. Prongs 23 and 24 have sharp points for penetrating the insulation and establishing an electrical contact with the internal stranded conducting elements 60 (FIG. 8) of cord 22.

Various types of blades are useable with the connector. Three types of blades are seen in FIGS. 6*a*, 6*b* and 6*c*. Each blade has a prong 23, 23' or 24 at one end for piercing the insulation of cord 22 and for contacting one of the internal electrical conductor elements 60. Each blade also has a detent 39 which engages shoulder 42 (FIG. 7) and helps to hold the blade in housing base 12. Blade 18 is the blade occupying the recess nearest the hinge 70 in housing base 12. (FIGS. 1 and 2). Blade 19 occupies the other recess, which is wide enough also to accommodate blade 19'. Blade 19', which is wider than blade 18, is used in the connector when it is desired to provide a polarized plug connector. Blade 19 is used when a standard plug is desired. It has shoulders 40 and 41 which make that portion of the blade internal to housing base 12 the same width as blade 19'. Thus, housing base 12 may be used to form either standard or polarized connectors without modification of the housing itself.

The present invention may be readily adapted for use with European-type electrical systems by replacing the flat blades with round pin-type connectors.

Projecting rib 21 on housing base 12 abuts cord 22 when the housing is closed and locked by clip 20 to help hold cord 22 in place. The housing cover 13 holds the locking clip 20 and a retaining clip 25. Retaining clip 25 is a spring tension clip adapted to urge cord 22 downward into channel 26 and to center the cord in the channel.

FIG. 5 shows the details of retaining clip 25, having wings 34 which slide into recesses 35 in housing cover 13 (FIG. 8). Clip 25 is held in place by tension resulting from lateral compression of wings 34 by the housing. Arm 36 extends outward and downward from body 37 of clip 25 to form a tension spring terminating in forked guide hand 38 with fingers 50. The space between fingers 50 in the fork of guide hand 38 is adapted to fit snugly around the smallest cord size to be used in the connector.

FIG. 7 shows the connector configured as a plug and having received a cord 22 and been locked closed. In this view can be seen shoulders 42 in housing base 12 which engage detents 39 in blades 18 and 19 to help hold the blades securely in the housing. Rib 21, projecting from the housing cover 13 cooperates with the bottom 31 of cross member 32 of locking clip 20 to grasp and crimp cord 22 and so assist in holding the cord securely in the connector. Forked guide hand 38 of retaining clip 25 engages cord 22 and, due to the spring force of arm 36, urges cord 22 against the floor 26 of the internal channel of housing cover 13.

Prongs 23 and 24 (FIG. 2), upon closing of the connector, pierce the insulation of cord 22 and make secure contact with the internal electrical conducting elements 60 of the cord. While shown solid, these will be the usual stranded wire. The housing sections are held together in the closed position by the engagement of cross member 33 with projection 44, which is an integral molded part of housing base 12.

In FIG. 8 may be seen the compression and distortion of cord 22 when the connector is closed and the centering of the cord by guide hand 38 of spring clip 25. FIG. 8 also shows the channel design of housing cover 13. This channel has a generally flat floor 45 having a longitudinal rib 46 projecting therefrom. Rib 46 engages groove 47 in cord 22 to help guide cord 22 into the center of the channel. Spring clip 25 further assists in centering cord 22. The sidewalls of the channel are formed in a plurality of sections, in this example, two for each side. Lower sidewall sections 48, the sections adjacent the floor of the channel, lie at an angle to the floor such that the force of the prongs 23 and 24 and spring clip 25 compresses and distorts the insulation of cord 22 so that the conductor elements 60 of cord 22 are aligned with prongs 23 and 24 regardless of variations in insulation thickness or distance between the conductor elements. The preferred angle between sidewall sections 48 and floor section 45 has been found to be $44° \pm 0.5°$. Upper sidewall sections 49 complete definition of the channel in housing cover 13 and lie generally normal to floor section 45. As can be seen in FIG. 8, fork guide hand 38 of spring clip 25 engages snugly about cord 22. A larger cord would contact wings 50 and so be centered in the channel. The largest cord with which the connector would be suitable for use would abut sidewall sections 49 and so be self-centering without the assistance of clip 25.

FIG. 9 further illustrates the compression and distortion of the insulation of cord 22 and the consequent alignment of the conductor elements 60 with prongs 23 and 24. FIGS. 10, 11, and 12 illustrate this same principle with three common sizes of household electrical cords and show that the connector makes a safe and secure electrical connection despite variations in insulation thickness and resulting variations in the distance between conductor elements.

FIG. 10 illustrates the use of SPT-1 18 wire. Because the SPT-1 18 cord does not fill the channel floor, compression of the cord 22 by the force of prongs 23 and 24 tends to force apart the groove 47 and so spreads cord 22 outward toward the walls 48 and thus spreads the internal conducting elements slightly apart and into alignment with prongs 23 and 24.

FIG. 11 illustrates the use of SPT-2 18 wire. This size cord lies against sloped wall sections 48. The compressive force applied by prongs 23 and 24 coacts with the opposite force exerted against the cord by these wall sections to slightly compress the cord horizontally and thereby again align the internal conductor elements 60 with prongs 23 and 24.

FIG. 12 illustrates the use of SPT-2 16 and HPN wire which are compressed and distorted by the coaction of prongs 23 and 24 and wall sections 48 in the same way as the SPT-2 18 wire.

FIG. 13 illustrates the operation of the connector with a cord 22 of intermediate size. Because the cord does not completely fill the channel 26 as would a larger cord, fingers 50 of clip 25 contact the cord and cooperate with longitudinal rib 46 to center the cord in the channel so that prongs 23 and 24 will make contact with the internal conductor elements 60 of cord 22, as discussed above.

The connector is installed easily without the use of tools and without any stripping or slitting of the cord. To accomplish this, cord 22 is passed under cross member 32 of locking clip 20 and is pushed into internal channel 26 of base 13 until it abuts hinge 70. Spring clip 25 and longitudinal rib 46 serve to center cord 22 in channel 26. Cover 12 is then rotated around hinge 70 and forced down upon base 13 until locking clip 20 engages projection 44 (FIG. 7) to securely lock the housing around cord 22. During this forced closing of the housing, the conducting elements 60 of cord 22 are automatically aligned with and penetrated by prongs 23 and 24. The result is a safe, secure electrical contact.

Another embodiment of the electrical connector of the present invention is the receptacle 75 shown in FIGS. 14–16. Like the plug embodiment, the receptacle is comprised of a base 80 and a cover 81, connected by hinge 82. The housing of receptacle 75 is secured around a suitable electrical cord by locking clip 94 which is mounted in recess 95 of cover 81 and engages shoulder 96 of base 80. The receptacle cover has two parallel slots 83 and 84 therein for receiving the conducting blades of an electrical plug, such as blades 18 and 19 of FIG. 3. It will be noted that slot 84 is somewhat wider than slot 83, to allow for use of the receptacle with polarized plug connectors, such as one using blade 19' of FIG. 6c.

Although the receptacle is usable with a regular or a polarized plug, the housing is purposely made sufficiently wide that a three-pronged grounded plug may not be improperly inserted into the receptacle. With a narrower housing, the two flat blades of a three-pronged plug could be inserted into slots 83 and 84 while the grounding element passed outboard of the housing. The wide housing of the present invention prevents this unsafe practice.

FIG. 15 illustrates the internal design of receptacle 75. The cover 81 can be readily seen to incorporate the channel design of the plug connector 10 (FIG. 2). In the receptacle design, spring clip 25 is not required as a guide means, as cord 22 (FIG. 16) is centered by the coaction of longitudinal ribs 86 and 87. Compression of cord 22 in the internal channel 88 of cover 81 is accomplished by the forced closing of base 80 and the penetration of the insulation of cord 22 by prongs 89.

Prongs 89 are preferably integral parts of contact elements 90 and 91, which are inserted in recesses in base 80, and are formed of a suitable electrically conducting material. When inserted in the recesses 83 and 4 (FIG. 14) of base 80, the curved portion 92 of contact elements 90 and 91 is compressed because the width of the recesses 83 and 84 is somewhat less than the diameter of the curve of portion 92. This compressive force serves to urge conducting plates 93 against the inner surfaces of recesses 83 and so both holds contact elements 90 and 91 in place in base 80 and also insures a secure contact with inserted conducting blades of a plug connector, such as blades 18 and 19 of FIG. 3.

Housing cover 81 and base 80 are held in the closed position by locking clip 94 which is mounted in cover 81 and, upon closing of the base 80 on cover 81, engages shoulder 96 to securely lock the housing around cord 22.

FIG. 16 illustrates the compression and distortion of cord 22, and consequent alignment of conducting elements 60 of cord 22 with prongs 89. This compression, distortion and alignment occurs in the receptacle as a result of the force of closing base 80 on cover 81 and the resultant forcing of the cord 22 into the internal channel 88. The description of this operation in conjunction with the plug connector applies equally to the receptacle.

Installation of receptacle 80 is accomplished by laying the cord 22 in channel 81. Ribs 86 and 87 center the cord by engaging grooves 47 in cord 22. The base 80 is then rotated on hinge 82 until it closes and locks with cover 81. As this is done, the force of the base 80 and prongs 89 against the cord in channel 88 will align conducting elements 60 with prongs 89 and prongs 89 will penetrate the insulation of cord 22 to make a secure electrical contact with conducting elements 60. Each prong 89 in a pair of prongs on either contact element 90 or 91 is slightly offset from the centerline to further insure a secure electrical contact.

In the embodiment shown, both ends of channel 88 are open so that receptacle 80 may be placed at any intermediate point on an electrical cord. If a receptacle is desired only at one end of an electrical cord, channel 88 may be made with an opening only at one end of receptacle 75, thus preventing a cord from passing completely through the receptacle.

I claim:

1. An insulated connector for flat, two-conductor element grooved electrical cords within a range of sizes commonly used in household applications, comprising:

a. a housing formed of a base hingedly connected to a cover with an internal channel adapted to receive an electrical cord;

b. electrically conducting prongs having integral blades extending externally of the housing and suitable for insertion into a household electrical outlet, the prongs being mounted in the base in position to pierce the cord and contact the conductor elements when the cover is closed on the base;

c. the internal channel having a substantially flat floor and sidewalls formed in two sections, the lower sidewall sections being sloped at an angle of 44°±5° to the floor, the upper sidewall sections being generally normal to the floor such that the force of the prongs and the base on the cord upon closing of the housing around the cord compresses and distorts the cord within the channel to align the conductor elements with the prongs;

d. a longitudinal rib protruding from the floor of the channel to engage the groove in the cord;

e. a tension spring clip mounted in the cover to urge the cord against the floor and to cooperate with the longitudinal rib to center the cord in the channel; and f. a locking clip mounted in the cover at the end opposite the hinge to engage a shoulder in the corresponding end of the base to securely lock the housing around the cord.

2. An insulated connector for flat, two conductor element electrical cords within a range of sizes commonly used in household applications, comprising:

a. a housing formed of a cover hingedly connected to a base;

b. the cover having an internal channel adapted to receive an electrical cord, the channel having a substantially flat floor and sidewalls formed in a plurality of sections, the lower sections being sloped at an oblique angle to the floor and the upper sections being generally vertical;

c. electrically conducting prongs mounted in the base in position to pierce the cord and contact the conductor elements when the cover is closed on the base;

d. contact means mounted in the base and electrically connected to the prongs;

e. a tension spring clip mounted in the cover to center the cord in the channel; and f. locking means to securely lock the cover and base together around the cord.

3. An insulated connector for flat, two-conductor element electrical cords, comprising:

a. a housing formed of a cover hingedly connected to a base;

b. the cover having a single internal channel adapted to receive a flat, two-conductor element electrical cord having a size selected from the group of SPT-1 No. 18, SPT-2 No. 18, HPN No. 18, SPT-2 No. 16, HPN No. 16 and without the need for slitting or stripping the cord, the channel having a substantially flat floor and sidewalls formed in plurality of sections, the lowermost sections being sloped at an angle of approximately 44° to the floor and the upper sections being generally vertical;

c. a pair of electrically conducting prongs mounted in the base to be movable in unison to pierce the cord simultaneously and arranged each to contact one of the conductor elements when the cover is closed on the base;

d. contact means mounted in the base and electrically connected to the prongs;

e. guide means mounted in the cover to center the cord in the channel; and f. locking means to lock securely the cover and base together around the cord.

4. The connector of claim 3 wherein the contact means comprises blades suitable for insertion into a household electrical outlet.

5. The connector of claim 3 wherein the oblique angle of the lower sidewall section to the channel floor is 44°±5°.

6. The connector of claim 3 wherein the guide means is a longitudinal rib on the inner face of the base projecting into the internal channel.

7. The connector of claim 3 wherein the contact means comprises contact elements formed of electrically conducting material and mounted in recesses in an external face of the housing to provide one or more electrical receptacles.

8. An insulated connector for flat, two-conductor element electrical cords, comprising:

a. a housing formed of a cover hingedly connected to a base;

b. a pair of electrically conducting prongs mounted in the base to be movable in unison to pierce the cord simultaneously and arranged each to contact one of the conductor elements when the cover is closed on the base;

c. the cover having a single internal channel adapted to receive a flat, two-conductor element electrical cord having a size selected from the group of SPT-1 No. 18, SPT-2 No. 18, HPN No. 18, SPT-2 No. 16, HPN No. 16 and without the need for slitting or stripping the cord, the channel having a substantially flat floor and sidewalls formed in a plurality of sections, the lowermost sections being sloped at an angle of approximately 44° to the floor and the upper sections being generally vertical such that the force of the prongs and the base on the cord upon closing of the housing around the cord compresses and distorts the cord within the channel to align the conductor elements with the prongs despite variations in the spacing of the conductor elements due to differing cord sizes and insulation thicknesses encountered in cords within the range of size commonly used in household applications;

d. contact means mounted in the base and electrically connected to the prongs;

e. guide means mounted in the cover to center the cord in the channel; and f. locking means to lock securely the cover and base together around the cord.

9. The connector of claim 8 wherein the contact means comprises blades suitable for insertion into a household electrical outlet.

10. The connector of claim 8 wherein the guide means is a longitudinal rib on the inner face of the base projecting in to the internal channel.

11. The connector of claim 8 wherein the oblique angle of the lower sidewall section to the channel floor is 44°±0.5°.

12. The connector of claim 8 wherein the contact means comprises contact elements formed of electrically conducting material and mounted in recesses in an external face of the housing to provide one or more electrical receptacles.

* * * * *

UNITED STATES PATENT AND TRADEMARK OFFICE

CERTIFICATE OF CORRECTION

PATENT NO. : 5,041,013
DATED : August 20, 1991
INVENTOR(S) : Arthur Greenbaum

It is certified that error appears in the above-indentified patent and that said Letters Patent is hereby corrected as shown below:

Col. 5, line 57, change "4" to --84--

Col. 6, line 48, change "44° ± 5° to --44° ± .5°--

Col. 7, line 47, change "44° ± 5° to --44° ± .5°--

Signed and Sealed this

Tenth Day of May, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,041,013
DATED : August 20, 1991
INVENTOR(S) : Arthur Greenbaum

It is certified that error appears in the above-indentified patent and that said Letters Patent is hereby corrected as shown below:

Title page, item [73], Assignee: should read--Academy Electrical Products Corp.--

Signed and Sealed this

Twelfth Day of March, 1996

*Attest:*

*Attesting Officer*

BRUCE LEHMAN

*Commissioner of Patents and Trademarks*